US006068414A

United States Patent [19]

Verhoest et al.

[11] Patent Number: 6,068,414

[45] Date of Patent: May 30, 2000

[54] ROLLER FOR USE IN A PHOTOGRAPHIC SHEET MATERIAL WET PROCESSING APPARATUS

[75] Inventors: Bart Verhoest, Niel; François Joos, Puurs, both of Belgium

[73] Assignee: Agfa-Gevaert, Mortsel, Belgium

[21] Appl. No.: 09/195,809

[22] Filed: Nov. 19, 1998

[30] Foreign Application Priority Data

Nov. 2, 1997 [EP] European Pat. Off. ..... 97203632

[51] Int. Cl.[7] ..... G03D 3/08

[52] U.S. Cl. ..... 396/614; 396/624; 396/636

[58] Field of Search ..... 396/617, 622, 396/624, 636, 614; 118/405; 29/895, 895.21, 895.22, 895.23; 492/47

[56] References Cited

U.S. PATENT DOCUMENTS

| | | | |
|---|---|---|---|
| 4,166,688 | 9/1979 | Sachs | 354/319 |
| 4,166,689 | 9/1979 | Schausberger et al. | 396/617 |
| 4,360,259 | 11/1982 | Burgess et al. | 396/574 |
| 4,621,400 | 11/1986 | Van Der Graaf | 472/47 |
| 4,864,704 | 9/1989 | Hogan et al. | 492/47 |
| 5,528,329 | 6/1996 | Sawada et al. | 354/320 |
| 5,678,118 | 10/1997 | Van Den Bergen | 396/612 |
| 5,745,816 | 4/1998 | Verlinden et al. | 396/614 |

FOREIGN PATENT DOCUMENTS

| | | |
|---|---|---|
| 0150924 | 8/1985 | European Pat. Off. . |
| 9119226 | 12/1991 | WIPO . |

*Primary Examiner*—Alan A. Mathews
*Attorney, Agent, or Firm*—Baker Botts L.L.P.

[57] ABSTRACT

The roller (20) comprises a main body member (31), a shaft (46) fixed to the main body member (31) and extending from one end thereof, and an end member (34) in contact with the main body member (31), characterised in that the end member (34) is mounted on the shaft (46) in a replaceable manner.

6 Claims, 3 Drawing Sheets

ROLLER FOR USE IN A PHOTOGRAPHIC SHEET MATERIAL WET PROCESSING APPARATUS

FIELD OF THE INVENTION

This invention relates to rollers suitable for use in photographic sheet material processing apparatus, and to apparatus including such rollers. Such an apparatus is suitable for the wet processing of X-ray film, pre-sensitised plates, graphic art film and paper, and offset plates,

BACKGROUND OF INVENTION

As a rule, a processing apparatus for photographic sheet material comprises several vessels each of which contains a treatment liquid, such as a developer, a fixer and a rinse liquid. As used herein, the term "sheet material" includes not only photographic material in the form of cut sheets, but also in the form of a web unwound from a roll. The sheet material to be processed is transported through these vessels in turn, by transport means such as one or more pairs of drive rollers, and thereafter optionally to a drying unit. The rollers are used in pairs, biased towards each other, between which the sheet material passes to act as a seal between treatment cells of the processing apparatus, that is to remove excess treatment liquid from the sheet as it passes from one treatment cell to the next. This reduces carry-over of treatment liquid and thereby reduces contamination and wastage. A good removal of processing liquid is also required to reduce the drying time of the sheet material after the last process bath, and hence to reduce the energy use.

A common construction of an apparatus for the wet processing of photographic sheet material includes at least one processing cell having an inlet and outlet together defining a sheet material path through the cell and a pair of rollers mounted between side plates in the cell and biased into contact with each other to form a nip there-between through which the sheet material path extends. Each of the rollers comprises a rigid core having a covering of elastomeric material secured to the core.

As described and shown in European patent application 95203464.3 (Agfa-Gevaert NV), the roller includes end parts comprising a wear resistant material vulcanised to the covering and in face-to-face sliding contact with an adjacent side plate.

Such a construction suffers from the disadvantage that after a period of use, the end parts of the covering suffer from wear, as a result of their sliding contact with the side plates, despite the incorporation of the wear resistant material. Such wear leads to leakage between the roller and the side plates. If this leakage is to be avoided, the roller must be replaced.

OBJECTS OF INVENTION

It is an object of the present invention to provide a roller in which this disadvantage can be avoided.

SUMMARY OF THE INVENTION

We have discovered that this objective, and other useful benefits, can be achieved where the end members are mounted on the roller in a replaceable manner and that such a construction can also be applied to other rollers used in a liquid processing apparatus.

Thus, according to a first aspect of the invention, there is provided roller suitable for use in a photographic sheet material wet processing apparatus, the roller comprising a main body member, a shaft fixed to the main body member and extending from one end thereof, and an end member in contact with the main body member, characterised in that the end member is mounted on the shaft in a replaceable manner.

In one embodiment of the invention, the roller is a path-defining roller wherein the main body member comprises a rigid core having a covering of elastomeric material secured to the core.

The rollers may act as drive rollers, serving to advance the sheet material through the apparatus. To meet these demands successfully, the resilience of the rollers is important. The rollers may comprise a rigid core having one or more covering layers of elastomeric material positioned over the core. The core of roller is fixed to the shaft, usually at each end thereof, the shafts being suitably welded to the end of the core, or integral therewith.

Preferably, the core and the roller shaft fixed thereto, have a flexural E-modulus of between 50 GPa and 300 GPa. Suitable materials for the rigid core include metals, such as stainless steel, non-ferrous alloys, titanium, aluminium or composites thereof. In one embodiment of the invention, the core is hollow. Alternatively the core is solid.

If the elastomeric material is too hard, the squeegeeing properties beyond the edges of the sheet material may not be optimum, resulting in an unacceptable level of carry-over. On the other hand, if the elastomeric material is too soft it will often contain oily materials which are liable to leach out of the elastomer and contaminate the sheet material, while the elastomeric material becomes progressively degraded.

As the sheet material leaves a given liquid treatment cell it is necessary to remove any liquid carried on the sheet material as efficiently as possible, to prevent carry-over of liquid into a next treatment cell and to reduce edge effects which arise from non-homogeneous chemistry on the sheet material after squeegeeing. This applies whether the apparatus is of a horizontal or vertical configuration. To do this job properly, the rollers must exert a sufficient and homogeneous pressure over the whole width of the sheet material. Also, to reduce edge effects, it is desirable that the opposite roller surfaces are in contact with each other beyond the edges of the sheet material. It has been proposed that, in order to equalise the pressure applied by the rollers to the sheet material across the width thereof, the rollers should not have an exactly cylindrical configuration, but rather the roller should be provided with a radial dimension profile which varies along the length thereof. This may be achieved by grinding the elastomer to provide the roller with the predetermined profile. As an alternative, the rigid core may be provided with a diameter which varies along the length thereof.

The Shore-A hardness of the elastomeric covering may be from 15 to 90.

The elastomeric material which is used for the covering may be selected from ethylene/propylene/diene terpolymers (EPDM), silicone rubber, polyurethane, thermoplastic rubber such as Santoprene (Trade Mark for polypropylene/EPDM rubber), styrene-butyl rubber and nitrile-butyl rubber and such materials doped with a surface modifying material selected from PTFE (poly tetra fluoro ethylene) particles, carbon fibres, glass fibres, glass beads and mixtures thereof to modify the surface thereof by reducing wear, lowering friction and enabling self-cleaning.

The covering will normally have a circular cross-section. The covering may have a total thickness which of from 5% to 45%, such as from 10% to 20% of the roller diameter, that is at least 1.0 mm, such as from 4 mm to 8 mm for a typical roller having a diameter of 40 mm.

An end member is in contact with the elastomeric covering and is preferably mounted on the roller shaft to rotate therewith. There is therefore no relative motion between the end member and the elastomeric covering, thereby ensuring no wear of the elastomeric covering at this point. Rather, there is face-to-face relative movement between the end member and its adjacent side plate.

Each end member may comprise a rigid annular member embedded in elastomeric material, the rigid annular member being so shaped as to fit over the roller shaft in a manner to rotate therewith. Preferably, the shaft has a non-circular cross-section portion located adjacent the main body member and the annular member has a matching non-circular aperture. For example, the shaft, while generally of circular cross-section, has a portion having at least one flat face. The annular member has a correspondingly shaped aperture, enabling the end member to slide in the axial direction along the roller shaft to enable the end member to be removed and replaced, while ensuring that the end member rotates with the roller. The annular member may be formed of a rigid material such as stainless steel, chrome-nickel alloys, and other corrosion resistant metals, and high temperature resistant plastics materials. Ideally, the end member has an outer dimension which is not greater than the outer dimension of the corresponding end of the main body member. Where the main body member has a circular cross-section, the end member has an outer diameter which is the same as the outer diameter of the adjacent end of the covering.

Suitable materials for the elastomeric material of the end member include ethylene/propylene/diene terpolymers (EPDM), silicone rubber, polyurethane, thermoplastic rubber such as Santoprene (Trade Mark for polypropylene/EPDM rubber), styrene-butyl rubber and nitrile-butyl rubber and mixtures thereof. The end members will usually include a wear resistant material such as PTFE (poly tetra fluoro ethylene) particles, carbon fibres, glass fibres, glass beads and mixtures thereof. The content of the wear reducing material in the elastomeric material of the end member may be from 1% to 35%, such as about 30% by weight. Higher levels of wear resistant materials may result in a disintegration of the elastomeric material.

The end members may be so shaped as to provide a space into which into which the elastomeric material of the covering may be deformed as a result of a sealing force between the roller and a sealing surface of the apparatus. Alternatively, the end members are a close fit on the roller shaft and are so shaped that no such space is provided.

The invention can be applied to an apparatus for the wet processing of photographic sheet material, comprising at least one processing cell having an inlet and outlet together defining a sheet material path through the cell and a pair of path-defining rollers biased into contact with each other to form a nip there-between through which the sheet material path extends, each of the path-defining rollers comprising a rigid core having a covering of elastomeric material secured to the core.

The apparatus may comprise a housing so formed as to define a number of processing cells mounted together in sequence, preferably with a substantially closed connection between adjacent cells.

Each cell may contain treatment liquid, passages in the housing being provided as an inlet and outlet for the treatment liquid.

The path-defining rollers are preferably positioned substantially parallel and in line contact with each other to form a squeegee pair. The roller shafts, which are fixed or integral with the core of the path-defining roller, are mounted at each end in bearings held in the housing. The roller shafts are biased towards each other to exert a pressure on the photographic sheet material as it passes between the path-defining rollers.

In order to obtain good processing quality it is advantageous for the path-defining rollers at the exit of each cell of the apparatus to exert a load in the order of 0.001 to 1.0 N/mm roller length, preferably 0.025–0.5 N/mm, to remove excess processing materials, the load practically being applied at each end of the path-defining rollers. To this end the path-defining rollers are biased together, for example, by making use of the intrinsic elasticity of the elastomeric material by the use of fixed roller bearings. Alternatively, use may be made of resilient means such as springs which act on the ends of the roller shafts. The springs may be replaced by alternative equivalent compression means, such as e.g. a pneumatic or a hydraulic cylinder.

It is preferred that both path-defining rollers of a roller pair have the same radial dimension profile for ease of manufacturing. Ideally, the radial dimension profile of each path-defining roller is such in relation to the biasing force applied to the path-defining rollers that the force applied by the path-defining rollers to sheet material passing there-between is substantially even over the width thereof. The radial dimension of each path-defining roller ideally decreases towards the ends thereof i.e. a convex profile, especially a parabolic profile.

In a preferred embodiment of the invention, the path-defining rollers are substantially equal in length. One or both of the path-defining rollers may constitute drive rollers for driving the sheet material along the sheet material path. Alternatively, the path-defining rollers may be freely rotating, alternative drive means being provided to drive the photographic sheet material through the apparatus.

Each of the path-defining rollers is preferably in sealing contact along its length, with a sealing member, for example a stationary sealing member or, more preferably, a rotatable sealing member. The sealing of one cell from the next and of the path-defining rollers to the housing of the associated cell is thereby achieved in a simple and reliable manner.

By the use of a rotatable sealing member in place of a stationary sealing member, the torque which needs to be applied to the path-defining rollers can be significantly reduced. This reduces the power needed by the apparatus, reduces wear on the path-defining rollers, reduces the mechanical deformation thereof and thereby extends the expected life time. This construction also improves the control of pressure distribution over the sheet material.

The rotatable sealing member preferably comprises a sealing roller, and in particular the sealing roller may have a diameter less than that of the path-defining roller. For example, the sealing roller may have a diameter which is from one tenth to one third of the diameter of the path-defining roller, thereby enabling the torque which needs to be applied to be further reduced. The sealing roller preferably extends in a straight line parallel to the associated path-defining roller axis and preferably contacts the surface of the associated path-defining roller at a location which is between 45° and 315°, most preferably between 135° and 225° from the centre of the nip, on the fluid side. It is also possible to employ two or more such sealing rollers in association with each path-defining roller.

The sealing roller may be formed of a material having a coefficient of friction (as measured against stainless steel) of less than 0.3, preferably from 0.05 to 0.2, for example highly polished metals such as steel, especially Cr—Ni steel and Cr—Ni—Mo steel, a metal coated with Ni-PTFE (NIFLOR—Trade Mark), a polymer material such as PTFE (poly tetra fluoro ethylene), POM (polyoxymethylene), HDPE (high density polyethylene), UHMPE (ultra high molecular weight polyethylene), polyurethane, PA (polyamide), PBT (polybutyl terephthalate) and mixtures and composites thereof.

In a preferred embodiment, the sealing roller is carried by a longitudinal bearing, secured within the housing.

In one embodiment of the invention, as described above, the path-defining rollers are mounted between the side plates in the cell, with shafts fixed to the core and extending from each end thereof. End members, in contact with the covering and an adjacent side plate, are mounted on the shafts in a replaceable manner.

In another embodiment of the invention however, the sealing rollers are mounted between the side plates in the cell and in sealing contact with the path-defining rollers, the sealing rollers comprising a main body member with shafts fixed to the main body member and extending from each end thereof. End members in contact with the main body member and an adjacent side plate, mounted on the shafts in a replaceable manner. In this manner, the ends of the sealing roller are in contact in a leak-free manner with the side plates.

Where end members for both the path-defining rollers and the sealing rollers are provided, it is preferred that the pressure between the side plate and the end members in contact therewith is substantially identical. This can be achieved where the axial dimension of the end member associated with the sealing roller is greater than the axial dimension of the end members associated with the path-defining rollers. This difference takes account of the rigid nature of the sealing roller main body member and the relatively resilient elastomeric covering of the path-defining roller.

The apparatus may have a horizontal configuration, where the sheet material is transported along a generally horizontal feed path, the sheet material passing from one cell to another under the surface of treatment liquid in each cell. The apparatus alternatively may have a substantially vertical orientation, in which a plurality of cells are mounted one above the other, each cell having an opening at the top acting as a sheet material inlet and an opening at the bottom acting as a sheet material outlet or vice versa. A combined horizontal-vertical configuration is also possible.

DETAILED DESCRIPTION OF THE INVENTION

The invention will be described by the following illustrative embodiments with reference to the accompanying drawings without the intention to limit the invention thereto, and in which.

Figure 1:
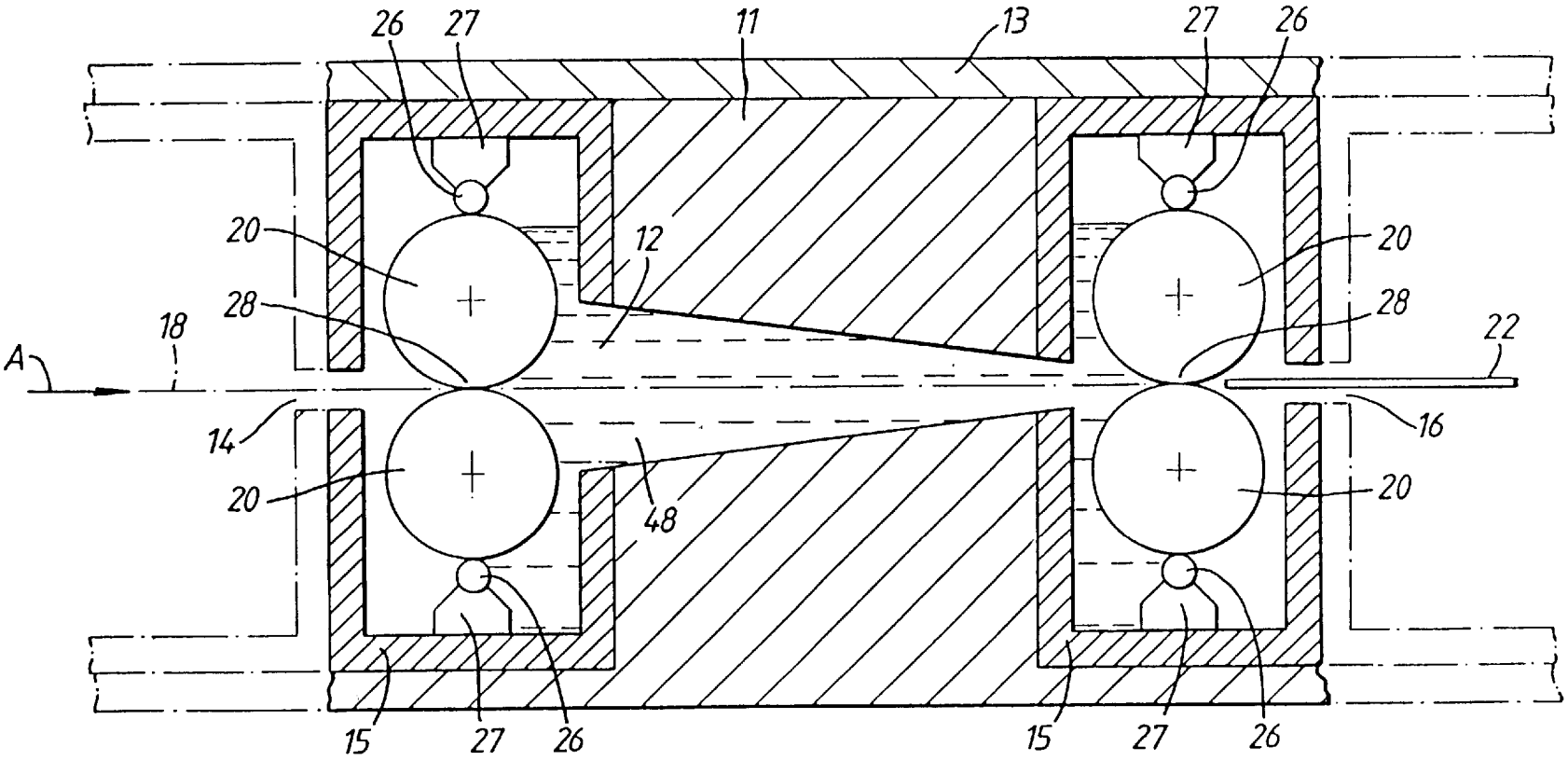
FIG. 1 shows part of an apparatus for the processing of photographic sheet material.

Referring to the drawings, an apparatus for the processing of photographic sheet material comprises a housing 11 having a lid 13 which can be removed for servicing purposes. A number of replaceable sub-housings or racks 15 are located within the housing and serve to define a number of sequential processing cells, of which only cell 12 is shown in detail. Other cells may be similarly constructed.

The cell 12 has an inlet 14 and outlet 16 together defining a sheet material path 18 through the cell and a pair of path-defining rollers 20 mounted between side plates 24 in the cell. The side plates 24 are screwed to the rack 15 by screws 25. Passages (not shown) through the housing 11 provide an inlet and outlet for the treatment liquid 48.

The path-defining rollers 20 are positioned substantially parallel and in line contact with each other. Each path-defining roller 20 is fixed on a respective shaft 46 for rotation, the roller shafts 46 being mounted at each end in bearings (not shown) held in the rack 15. The roller shafts are biased towards each other to exert a pressure on the photographic sheet material as it passes between the path-defining rollers. Compression springs (not shown) bias the path-defining rollers 20 towards each other with a force of up to 400 N at a roller length of about 850 mm into contact with each other to form a nip 28 there-between through which the sheet material path 18 extends. Each path-defining roller 20 is in sealing contact along its length, with a respective rotatable stainless steel sealing roller 26 carried on a sealing support 27, which in turn is secured to the rack 15 of the apparatus, the treatment liquid 48 being retained in the vessel 12 by the path-defining rollers 20 and the sealing rollers 26. The path-defining rollers 20 are drive rollers driven by a drive device (not shown) to transport photographic sheet material 22 along the path 18 in the direction of arrow A.

Each of the path-defining rollers 20 comprises a main roller body member 31 formed of a hollow stainless steel rigid core 30 and an elastomeric covering 32. The core 30 has an outside diameter of 25 mm and a wall thickness of 3 mm. The roller shaft 46 is suitably welded to the end of core 30, or is integral therewith. The elastomeric covering 32 is formed of EPDM and is secured to the core 30 by adhesive. The covering 32 has a circular cross-section, with a diameter of about 40 mm.

End members 34 are urged into in contact with the covering 32 and with adjacent side plates 24 secured to the rack 15. Each end member 34 is in contact with the elastomeric covering 32 and is mounted on the shaft 46 to rotate therewith. There is therefore no relative motion between the end member 34 and the elastomeric covering 32, thereby ensuring no wear of the elastomeric covering at this point. Rather, there is face-to-face relative movement between the end member 34 and the adjacent side plate 24. The force between the end members 34 and the side plate 24 can be adjusted by tightening or loosening of the screws 25.

The end member 34 comprises a rigid flat ring 36 formed of chrome-nickel alloy, embedded in elastomeric material 37 which is EPDM doped with approximately 30% by weight PTFE. The end member 34 has an outer diameter which is the same as the outer diameter of the corresponding end of the covering 32. The end member 34 is so shaped in relation to the core 30 as to provide a space 44 into which the elastomeric material of the covering 32 may be deformed as a result of a sealing force between the path-defining roller and the side plates 24.

The rigid flat ring 36 is so shaped as to fit over the roller shaft 46 in a manner to rotate therewith. To achieve this, the shaft 46has an enlarged portion 38, located adjacent the end of the covering 32, having two opposite flat faces, while the shaft 46 is otherwise of generally of circular cross-section.

The ring 36 has a correspondingly shaped aperture 42, enabling the end member to slide in the axial direction along the roller shaft 46 to be removed and replaced, while ensuring that the end member 34 rotates with the path-defining roller. The end members 34 are thus mounted on the shaft 46 in a replaceable manner.

Each sealing roller 26 comprises a main sealing roller body member 131 formed of stainless steel and having a diameter of 20 mm. A sealing roller shaft 146 is suitably welded to the end of body member 131, or is integral therewith.

End members 134 are urged into in contact with the body member 131 and with adjacent side plates 24 secured to the rack 15. Each end member 134 is in contact with the main sealing roller body member 131 and is closely mounted on the shaft 146 to rotate therewith. There is therefore no relative motion between the end member 134 and the main body member 131, thereby ensuring no wear of the elastomeric covering at this point. Rather, there is face-to-face relative movement between the end member 134 and the adjacent side plate 24. The force between the end members 134 and the side plate 24 can be adjusted by tightening or loosening of the screws 25.

The end member 134 is formed in a similar manner to end member 34, that is it comprises a rigid flat ring 136, embedded in elastomeric material 137 which is doped with PTFE. The end member 134 has an outer diameter which is the same as the outer diameter of the corresponding end of the main body member 131.

The rigid flat ring 136 is so shaped as to fit over the roller shaft 146 in a manner to rotate therewith. To achieve this, the shaft 146 has an enlarged portion 138, located adjacent the end of the main body member 131, having two opposite flat faces, while the shaft 146 is otherwise of generally of circular cross-section. The ring 136 has a correspondingly shaped aperture 142, enabling the end member 134 to slide in the axial direction along the roller shaft 146 to be removed and replaced, while ensuring that the end member 134 rotates with the path-defining roller.

The end members 134 are thus mounted on the sealing roller shaft 146 in a replaceable manner.

Figure 2:
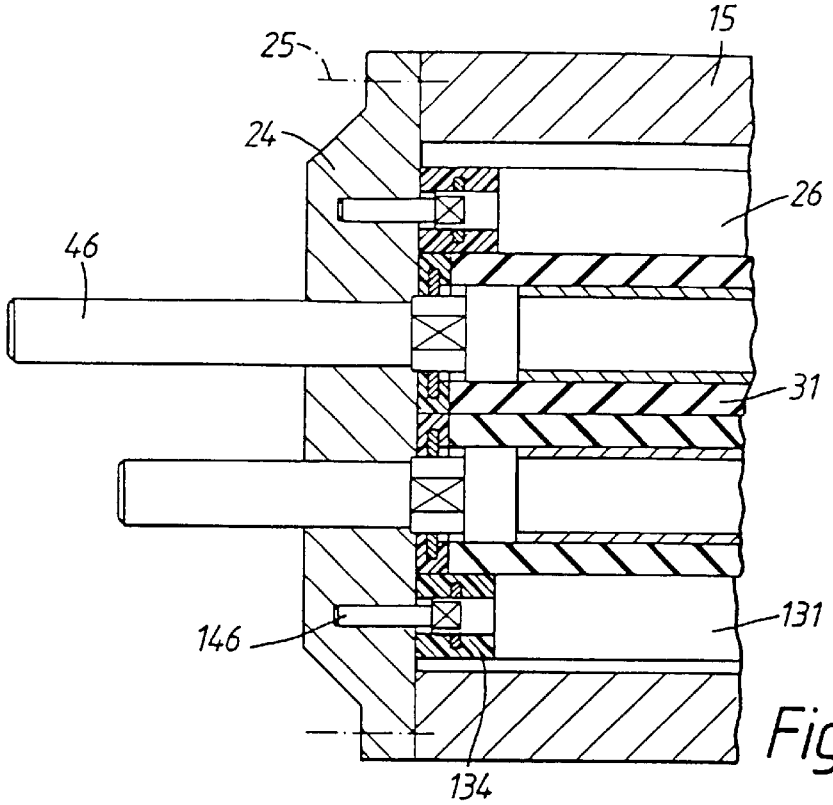
FIG. 2 is an enlarged view of one end of the path-defining roller pair of the apparatus shown in FIG. 1.
Figure 3:
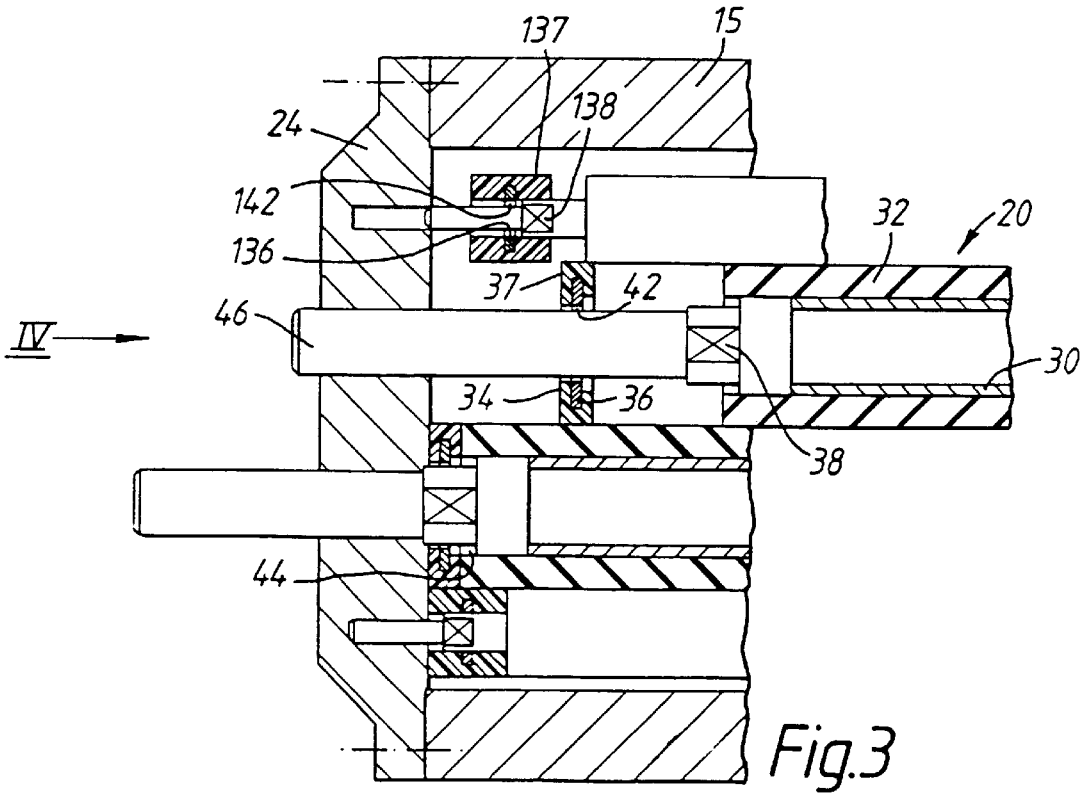
FIG. 3 is a view similar to FIG. 2, with one path-defining roller in a dis-assembled state.
Figure 4:
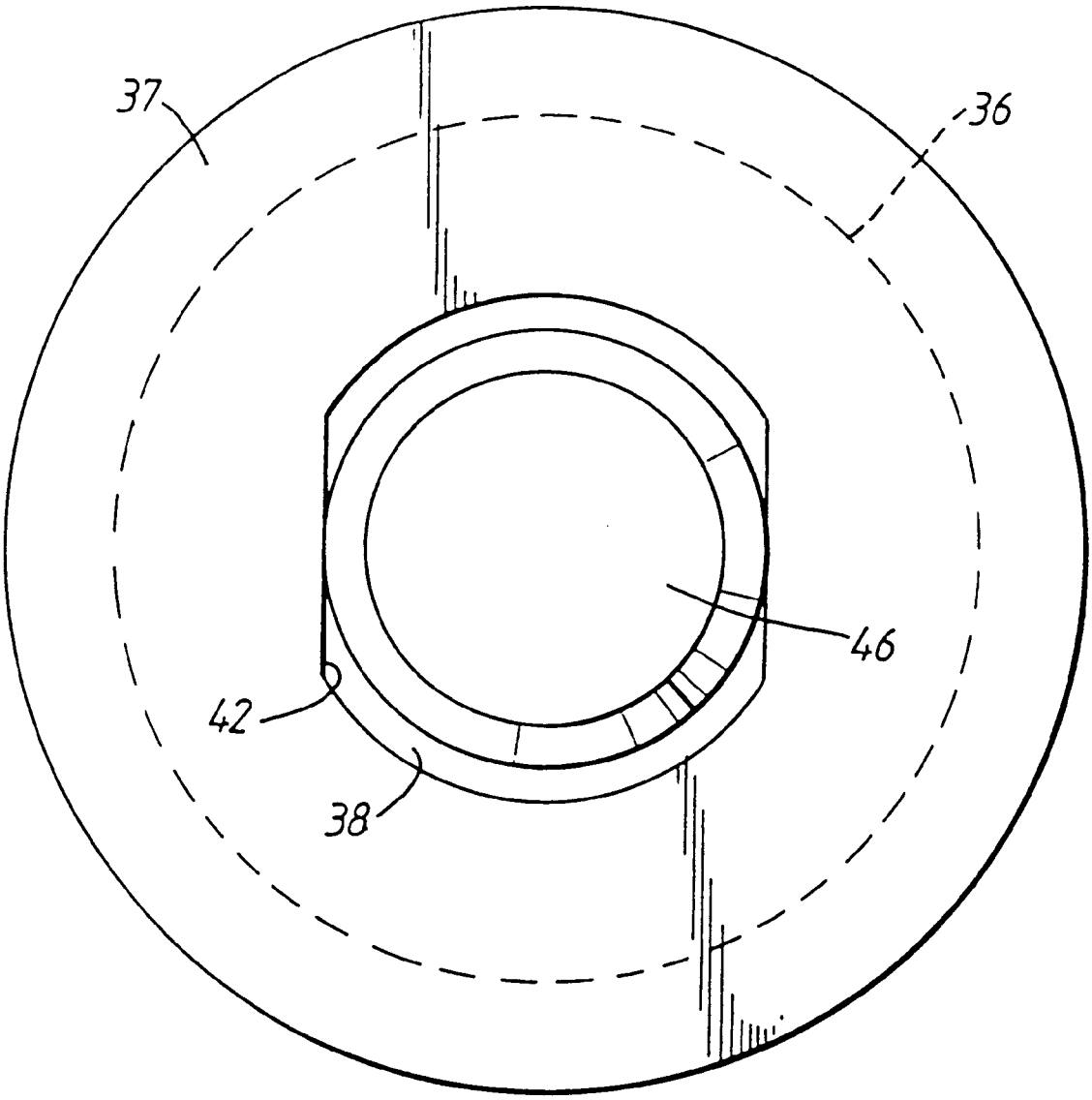
FIG. 4 is a view taken in the direction of the arrow IV in FIG. 3, with the side plate removed.

As can be seen from FIGS. 2 and 3, the axial dimension of the end members 134 associated with the sealing rollers 26 is greater than the axial dimension of the end members 34 associated with the path-defining rollers 20.

This difference takes account of the rigid nature of the sealing roller main body member 131 and the relatively resilient elastomeric covering 32 of the path-defining roller 20. In this manner, it is assured that the pressure between the side plate 24 and the two end members 34, 134 is substantially identical.

Reference Number List

| | |
|---|---|
| housing 11 | elastomeric material 37 |
| cell 12 | enlarged portion 38 |
| removable lid 13 | aperture 42 |
| inlet 14 | space 44 |
| rack 15 | shaft 46 |

-continued

Reference Number List

| | |
|---|---|
| outlet 16 | liquid 48 |
| path 18 | sealing roller body member 131 |
| path-defining rollers 20 | end members 134 |
| sheet material 22 | ring 136 |
| side plates 24 | elastomeric material 137 |
| sealing roller 26 | enlarged portion 138 |
| sealing support 27 | aperture 142 |
| nip 28 | sealing roller shaft 146 |
| main roller body member 31 | arrow A |
| core 30 | |
| covering 32 | |
| end members 34 | |
| ring 36 | |

What is claimed is:

1. An apparatus for the wet processing of photographic sheet material, comprising at least one processing cell having an inlet and outlet together defining a sheet material path through the cell and a pair of path-defining rollers biased into contact with each other to form a nip there-between through which said sheet material path extends, each of said path-defining rollers comprising a rigid core having a covering of elastomeric material secured to said core, and sealing rollers mounted between side plates in said cell and in sealing contact with said path-defining rollers, said sealing rollers comprising a main body member, shafts fixed to said main body member and extending from each end thereof, characterized by end members in contact with said main body member and an adjacent side plate, said end members being mounted on said shafts in a replaceable manner.

2. A roller suitable for use in photographic sheet material wet processing apparatus, the roller comprising a main body member, a shaft fixed to said main body member and extending from one end thereof, and an end member in contact with said main body member, said end member being mounted on said shaft in a replaceable manner, said main body member including a rigid annular member embedded in elastomeric material, said rigid annular member being so shaped as to fit over said shaft in a manner to rotate therewith, said shaft having a portion of non-circular cross-section, and said annular member having a non-circular aperture matching said portion of non-circular cross-section.

3. A roller according to claim 2, wherein said annular member is formed of metal.

4. A roller according to claim 2, wherein said end member has an outer dimension which is not greater than the outer dimension of the corresponding end of said main body member.

5. A roller according to claim 2, wherein said end member comprises a wear resistant material.

6. A roller according to claim 2, wherein said main body member comprises a rigid core having a covering of elastomeric material secured to said core.

* * * * *

UNITED STATES PATENT AND TRADEMARK OFFICE

CERTIFICATE OF CORRECTION

PATENT NO. : 6,068,414

DATED : May 30, 2000

INVENTOR(S) : Verhoest et al.

It is certified that error appears in the above-identified patent and that said Letters Patent is hereby corrected as shown below:

Title Page, Item [30] Foriegn Application Priority Data: "Nov. 2, 1997" should read -- Nov. 21, 1997 --.

Signed and Sealed this

First Day of May, 2001

*Attest:*

Nicholas P. Godici

NICHOLAS P. GODICI

*Attesting Officer*

*Acting Director of the United States Patent and Trademark Office*